US008224232B2

(12) United States Patent
Hattori

(10) Patent No.: US 8,224,232 B2
(45) Date of Patent: Jul. 17, 2012

(54) BOOKBINDING APPARATUS AND BOOKBINDING SYSTEM

(75) Inventor: Masato Hattori, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 576 days.

(21) Appl. No.: 12/407,927

(22) Filed: Mar. 20, 2009

(65) Prior Publication Data

US 2009/0245975 A1 Oct. 1, 2009

(30) Foreign Application Priority Data

Mar. 25, 2008 (JP) ..... 2008-077568

(51) Int. Cl.
*G03G 15/00* (2006.01)
*B42C 11/00* (2006.01)
*B42C 9/00* (2006.01)

(52) U.S. Cl. ..... 399/408; 412/4; 412/5; 412/19; 412/21; 412/20; 412/22

(58) Field of Classification Search ..... 399/408; 412/4, 5, 19, 20, 21, 22
See application file for complete search history.

(56) References Cited

U.S. PATENT DOCUMENTS

2007/0036637 A1* 2/2007 Hata et al. ..... 412/9
2007/0036638 A1* 2/2007 Yoshie et al. ..... 412/19
2008/0145187 A1* 6/2008 Kitta et al. ..... 412/14
2009/0074541 A1* 3/2009 Yamashita ..... 412/14

* cited by examiner

*Primary Examiner* — Judy Nguyen
*Assistant Examiner* — Allister Primo
(74) *Attorney, Agent, or Firm* — Finnegan, Henderson, Farabow, Garrett & Dunner, L.L.P.

(57) ABSTRACT

A bookbinding apparatus includes a glue coating device that coats glue on a back of a sheet bundle, a sheet bundle supporting device that supports the sheet bundle on which glue is coated a cover sheet supporting device that supports a cover sheet, a moving device that moves at least one of the sheet bundle supporting device and the cover sheet supporting device, and thereby changes a distance between the back of the sheet bundle and the cover sheet, and a control device that controls the moving device, wherein the control device controls the moving device so that a distance between the back of the sheet bundle on which the glue are coated and the cover sheet is set to a distance D1, then the distance is set to a distance D2 that is greater than the distance D1.

13 Claims, 12 Drawing Sheets

BOOKBINDING APPARATUS AND BOOKBINDING SYSTEM

RELATED APPLICATION

This application is based on Japanese Patent Application Publication No. 2008-077568, which was filed to Japan Patent Office on Mar. 25, 2008, and all the contents of this application shall be incorporated here by reference.

TECHNICAL FIELD

The present invention relates to a bookbinding apparatus that makes a booklet by a cover sheet to a sheet bundle composed of a plurality of sheets and by conducting binding processing and to a bookbinding system that makes a booklet by forming an image on a sheet and by conducting binding processing for sheets on which images are formed.

BACKGROUND

In recent years, a printing system called a POD (Print On Demand) system is in widespread use.

This system is utilized as a flexible system that can change contents of printing at any time for each page and further for each booklet, because the system is composed of combined image forming apparatus and a bookbinding apparatus in which bookbinding is carried out on the bookbinding apparatus while images are formed on sheets on the image forming apparatus.

Further, in this system, a bookbinding apparatus that makes a booklet by bundling sheets in a way of gluing by glues is also used as a device that conducts binding processing for a sheet bundle.

In the bookbinding apparatus that conducts binding processing for a sheet bundle by glues, a skillful technique and adjustment on a bookbinding process are necessary for making a high quality booklet that has sufficient booklet strength and is free from unevenness of glues formed on the outer side thereof by protrusion of glues and by uneven coating, and various improvements have been made.

Unexamined Japanese Patent Application Publication No. 2000-168265 discloses a technology to form a glue layer having a coating thickness corresponding to a thickness of a sheet bundle, by changing a height of a surface of revolution of a scrape roller corresponding to a thickness of a sheet bundle, in a coating device in which a coating thickness of glues can be adjusted by the scrape roller, after coating glues by the coating roller.

Unexamined Japanese Patent Application Publication No. 2006-346984 discloses a technology to improve finish on an outer surface of a glued cover while securing adhesive strength by coating twice through changes of a distance between a coating roller and a coated surface.

The booklet strength can be considered by dividing it mainly into resistance for spine breakage and adhesive strength, and if these two strengths can be secured sufficiently, sufficient booklet strength can be obtained.

Spine breakage is a phenomenon wherein spine SS is broken and bent when sheet bundle Sa is broken at its medium position as shown in FIG. 14(*a*), and resistance against force F1 that causes the spine breakage is resistance for spine breakage.

The adhesive strength is resistance against extracting force F2 when extracting force F2 for extracting one up to several sheets S from booklet S3 is applied on the booklet S3 as shown in FIG. 14(*b*).

The resistance for spine breakage is strengthened more mainly, as glue layer PS is made to be thicker. Namely, it is possible to enhance resistance for spine breakage by making a coating thickness to be thicker in coating glues.

The adhesive strength is enhanced mainly by increasing an amount of glues soaking into a space between sheet S and sheet S both constituting sheet bundle Sa and soaking into sheet S.

In the coating process, it is possible to cause glues to soak into a space between a sheet and a sheet and into a sheet itself by applying pressure on a glue layer before glues are solidified, in the course of conducting coating process or after coating, which increases the adhesive strength.

Though it is possible to increase the resistance for spine breakage and the adhesive strength by making a coating thickness of glues to be thicker and by applying pressure on a glue layer, glues protrude to both end portions of the sheet bundle Sa in the aforesaid occasion, and side glue SG is formed as shown in FIG. 14(*c*).

When a cover sheet is fitted, side glue SG causes unevenness of glues to be formed on a surface of the cover sheet, and an irregular side glue SG is formed on a border section between sheet bundle Sa and cover sheet S2 as shown in FIG. 14(*c*), thus, the side glue SG leads to quality loss of a booklet.

Only control of coating thickness as in Unexamined Japanese Patent Application Publication No. 2000-168265 cannot secure booklet strength and booklet quality sufficiently.

It is also impossible for coating twice as in Unexamined Japanese Patent Application Publication No. 2006-346984 to secure booklet strength and booklet quality sufficiently.

SUMMARY

An aspect of the invention is as follows.

1. A bookbinding apparatus comprising:

a glue coating device that coats glue on a back of a sheet bundle, a sheet bundle supporting device that supports the sheet bundle on which glue is coated a cover sheet supporting device that supports a cover sheet, a moving device that moves at least one of the sheet bundle supporting device and the cover sheet supporting device, and thereby changes a distance between the back of the sheet bundle supported by the sheet bundle supporting device and the cover sheet supported by the cover sheet supporting device, and a control device that controls the moving device, wherein the control device controls the moving device so that a distance between the back of the sheet bundle on which the glue are coated and the cover sheet is set to a distance D1 that the cover sheet contacts with coated glue thereby gluing the cover sheet to the sheet bundle, then, the distance is set to a distance D2 that is greater than the distance D1.

14. A bookbinding system comprising;

the bookbinding apparatus of claim 1, and an image forming apparatus that forms an image on a sheet and conveys the sheet on which an image is formed to the bookbinding apparatus.

DESCRIPTION OF THE PREFERRED EMBODIMENT

Figure 1:
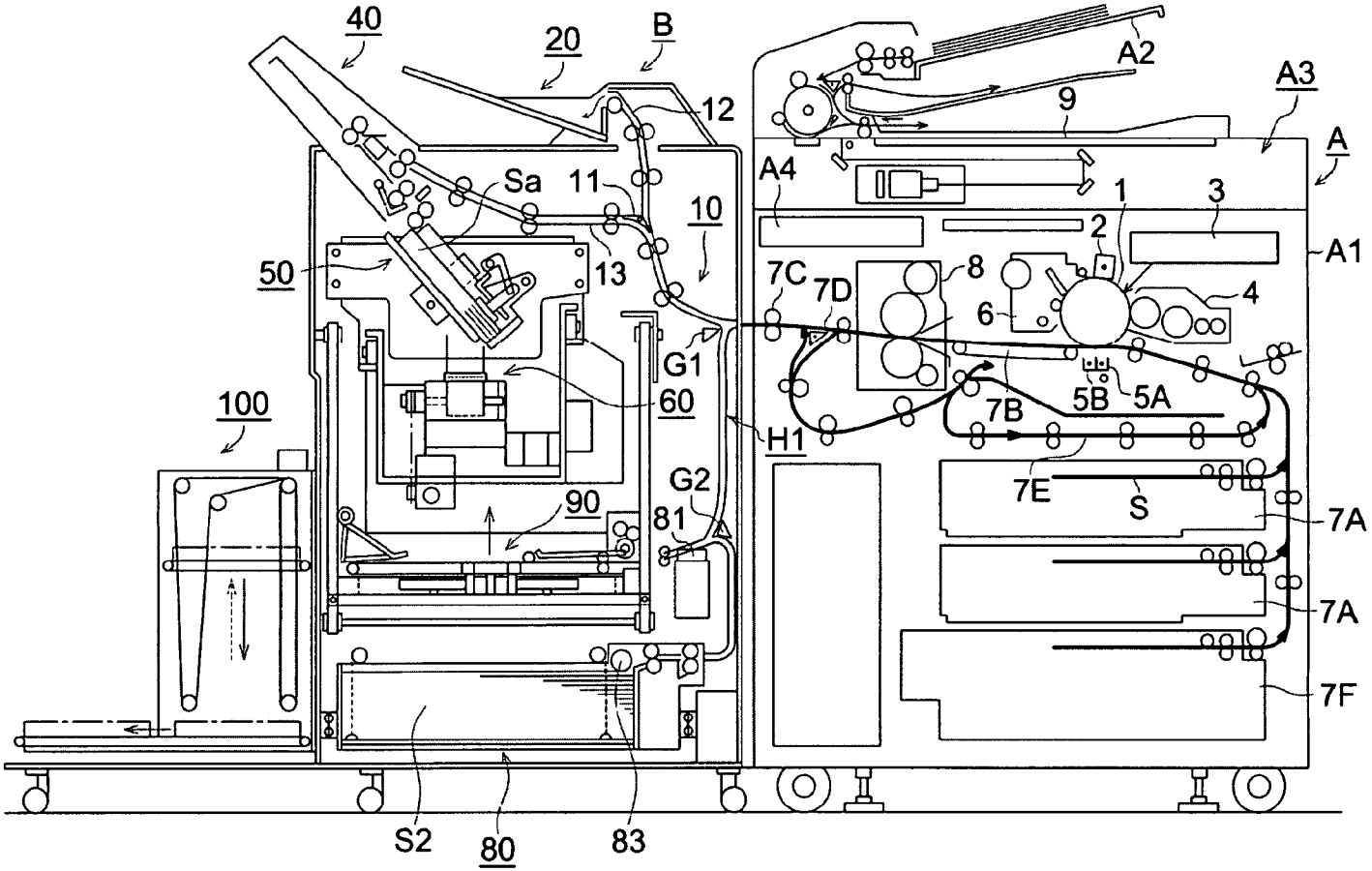
FIG. 1 is an overall structural diagram of a bookbinding system equipped with an image forming apparatus and a bookbinding apparatus.

Next, a bookbinding apparatus, an image forming apparatus and a bookbinding system all of the invention will be explained as follows, referring to the drawings.

<Image Forming Apparatus A>

FIG. 1 is an overall structural diagram of a bookbinding system equipped with image forming apparatus A and bookbinding apparatus B.

The image forming apparatus A has in its image forming apparatus main body Al rotating image carrier 1 and an image recording device including charging unit 2, imagewise exposure unit 3, developing unit 4, transfer unit 5A, neutralizing unit 5B and cleaning unit 6 which are arranged on a circumference of the image carrier. The image recording device conducts electric charging evenly on a surface of the image carrier 1 with the charging unit 2, and then, carries out exposure scanning that is based on image data which are read out of a document by a laser beam of the imagewise exposure unit 3 to form a latent image, whereby, the image recording device conducts reversal development for the latent image with the development unit 4 to form a toner image on a surface of the image carrier 1. Incidentally, the image forming apparatus A forms an image also by images of image data received from image data preparing device representing an outer equipment such as personal computer PC.

Further, in the following explanation, sheets that constitute contents of a booklet is called sheet S1, a bundle of sheets composed of a plurality of sheets is called sheet bundle Sa, a sheet for a cover sheet is called cover sheet S2 and the sheet bundle Sa to which a sheet for a cover sheet is connected is called booklet S3. Meanwhile, with respect to cover sheet S2, there is sometimes an occasion where a cover sheet printed by image forming apparatus A is expressed as cover sheet S2A, and a cover sheet stored in a bookbinding apparatus is expressed as cover sheet S2B, distinctly.

A sheet storage section is equipped with sheet storage section 7A that stores sheet S1 and with cover sheet storage section 7F, and sheet S1 fed from the sheet storage section is conveyed to a transfer position. At the transfer position, the aforesaid toner image is transferred onto sheet S1. After that, electric charges on the back side of the sheet Si are eliminated by neutralizing device 5B and the sheet S1 is separated from image carrier 1, then, is conveyed by conveyance section 7B and is heated and fixed by fixing device 8 to be ejected from sheet ejection roller 7C.

When conducting image forming on both sides of sheet S1, the sheet S1 subjected to fixing processing by fixing device 8 is caused by conveyance path switching plate 7D to branch from an ordinary sheet ejection path, and it takes a switchback course at reversal conveyance section 7E to be reversed inside out, to be fed again to the image forming section.

Sheet S1 which has been subjected to image forming on its reverse side and has been subjected to fixing processing is ejected to the outside of the apparatus from sheet ejection roller 7C. The sheet S1 ejected from the sheet ejection roller 7C is fed into bookbinding apparatus B.

When conducting image forming on cover sheet S2 on image forming apparatus A, the cover sheet S2 which has been subjected to fixing processing in fixing device 8 is caused by conveyance path switching plate 7D to branch from an ordinary sheet ejection path.

At a point in time when a trailing edge of the cover sheet S2 passed a branching point, the rotation direction of each conveyance roller that interposes the cover sheet S2 is switched, and the cover sheet S2 is conveyed with its leading edge and a trailing edge reversed each other, toward sheet ejection roller 7C, thus, the cover sheet S2 is ejected from the sheet ejection roller 7C to the outside of the apparatus.

Automatic document feeder A2 conveys documents to a reading position one sheet by one sheet. Image reading section A3 reads out a document conveyed by the automatic document feeder A2, or a document placed on document platen 9 to generate image signals. Communication section A4 communicates with equipment on a network, and receives image forming instructions transmitted from a network to generate image data.

With respect to a surface of image carrier 1 after image processing, toner staying on the surface is removed by cleaning device 6 to be ready for succeeding image forming.

Next, bookbinding apparatus B will be explained, and the invention is not limited to the embodiment of the invention.

<Bookbinding Apparatus B>

Figure 2:
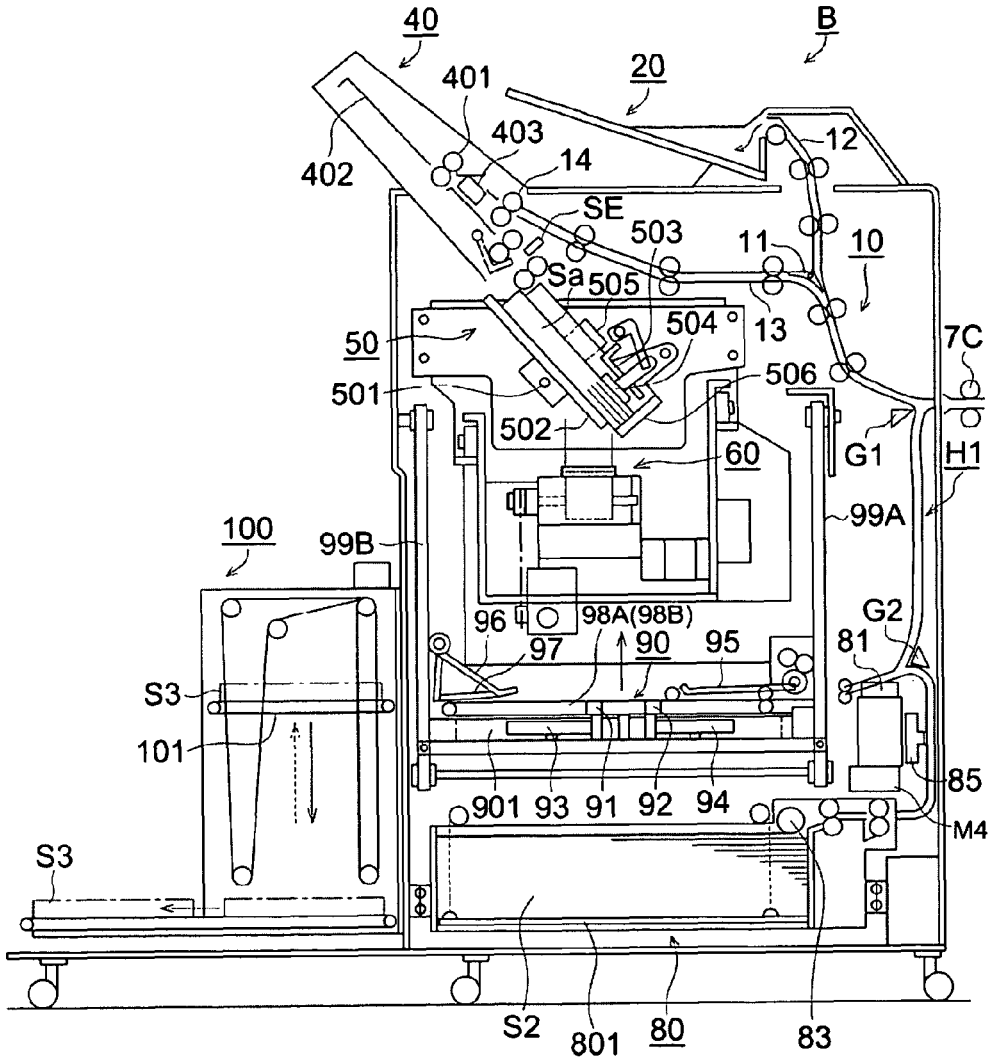
FIG. 2 is a sectional view of a bookbinding apparatus.

FIG. 2 is a front schematic sectional view of bookbinding apparatus B.

Bookbinding apparatus B has therein conveyance section 10, stacking section 50 where sheets S are stacked, coating device 60, cover sheet storage section 80 representing the second cover sheet storage section that stores cover sheet S2B, sheet feeding roller 83 that feeds cover sheet S2B, cutter 81 that cuts cover sheet 82 to the length corresponding to a bundle of sheets S1, cover sheet supporting section 90 that supports the cover sheet and booklet ejecting section 100.

Switching gate G1 switches a conveyance path for sheet S1 or cover sheet S2 ejected from image forming apparatus A.

When a sheet ejected out from image forming apparatus A is sheet S1, the sheet S1 is conveyed to conveyance section 10 by switching gate G1, and then, is ejected out to sheet ejection tray 20 through ejection path 12, or is conveyed to sheet reversing section 40 by switching gate 11. When bookbinding designation is not designated at an operation section of the image forming apparatus A, the sheet S1 is ejected out to the sheet ejection tray 20.

When a sheet ejected out from image forming apparatus A is cover sheet S2A, the cover sheet S2A is conveyed to conveyance section H1 by conveyance path switching gate G1. It is further conveyed to cover sheet supporting section 90 through cutter 81 by switching gate G2 that conducts switching between cover sheet S2B conveyed from cover sheet storage section 80 and the cover sheet S2A.

When bookbinding designation is designated at an operation section of the image forming apparatus A (which is called a bookbinding processing mode), sheet S1 is conveyed to sheet reversing section 40 through conveyance path 13, and is conveyed to sheet stacking section 50 after taking a switchback course at sheet reversing section 40. In the sheet stacking section 50, sheets S1 in established quantity are stacked, and when all of the sheets in established quantity are stacked, the sheet stacking section 50 rotates while interposing the sheets, and holds bundle Sa of sheets S1 to be almost vertically.

Glues are coated by coating device 60 on spine SS (lower end surface in FIG. 2) of sheet bundle Sa that is held vertically by the sheet stacking section 50. Cover sheet S2 is brought into contact with sheet bundle Sa on which glues have been coated to be glued, and booklet S3 is prepared to be ejected out to booklet ejection section 100.

Each section of the bookbinding apparatus will be explained in detail as follows.

Sheet S1 which has been conveyed through conveyance path 13 is ejected by sheet ejection rollers 14 and is conveyed by swinging pressure contact rollers 401 to ascend through tilted reversing tray 402, and then, the swinging pressure contact rollers 401 rotates reversely to convey the sheet S1 downward. The sheet S1 conveyed downward falls on sheet stacking section 50 to be stacked.

The sheet S having fallen through sheet reversing section 40 is supported by a sheet supporting device composed of supporting plate 502 and stopper plate 506 on the sheet stacking section 50.

Sheets S1 ejected from an image forming apparatus in order are stacked on the sheet stacking section 50, and bundle Sa of sheets S1 is formed.

The number of sheets of sheets S1 forming sheet bundle Sa includes the number of documents counted by automatic document feeder A2 mounted on the image forming apparatus, the number of documents obtained from received image information that is transmitted by a personal computer and others and the number of documents inputted in advance by an operator.

Restraint member 504 is a member to hold down a lift of stacked sheets S1, and it separates from sheet S1 each time a sheet is supplied to sheet stacking section 50, to hold down sheet S1. Aligning plate 505 is a aligning plate that aligns edges of sheets.

At a point in time when sheets S1 in established quantity are stacked on sheet stacking section 50, holding plate 503 operates to interpose and hold sheet bundle Sa.

Under the condition that the sheet bundle Sa is interposed and held, the sheet stacking section 50 is rotated about axis 501 to change a state of sheet bundle Sa from the tilted one to the vertical one.

<Coating Process>

Figure 3:
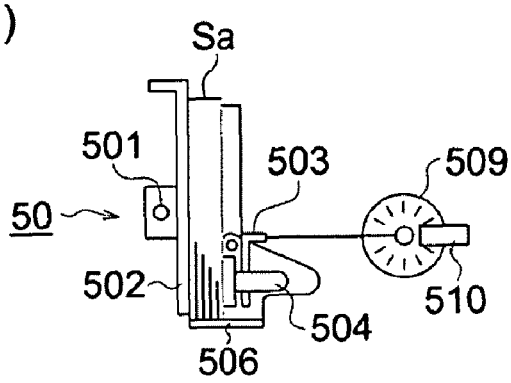
FIGS. 3(*a*)-3(*d*) represent diagrams showing processes for holding sheet bundle Sa vertically and for coating glues.
Figure 3:
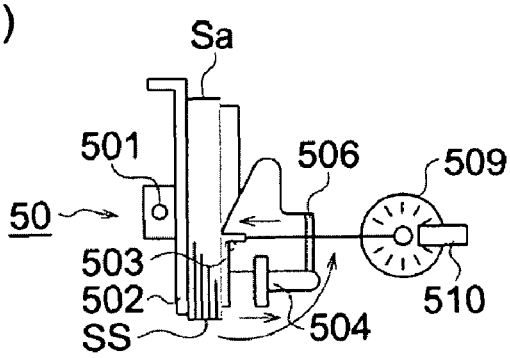
Figure 3:
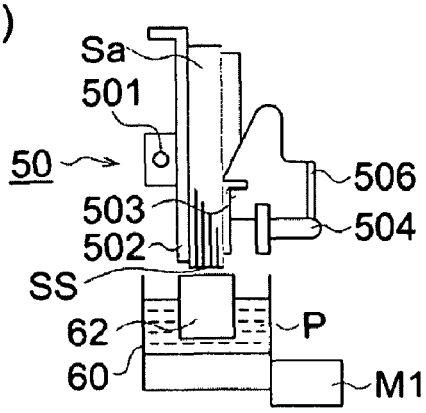
Figure 3:
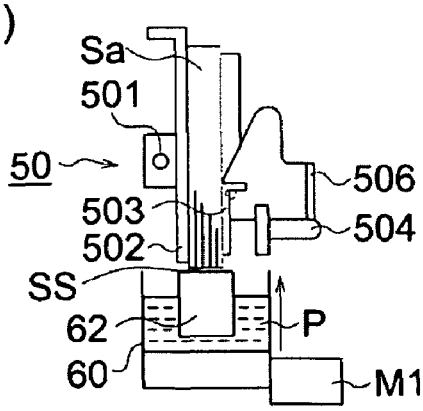

FIG. 3 shows a process to hold sheet bundle Sa to be perpendicular to the sheet stacking section 50, and to coat glues.

Before explaining the coating process, holding of a sheet by holding plate 503 will be explained as follows, referring to FIG. 3(*a*).

Before the sheet stacking section 50 is rotated to be in a vertical state, holding plate 503 is driven by a motor (not shown) to move, and it presses sheet bundle Sa. When the driving torque caused by the pressing is detected to arrive at a prescribed value and the pressing is stopped, the sheet bundle Sa is held firmly by supporting plate 502 and by holding plate 503. A stop position of the holding plate 503 is detected by sheet bundle thickness sensor 510 and by encoder 509. Owing to this, a thickness of sheet bundle Sa stacked on the sheet stacking section 50 can be grasped through actual measurement. The sheet stacking section 50 rotates until the moment when it becomes to be in vertical state around axis 501 serving as the center, under the condition that the sheet bundle Sa is held firmly by supporting plate 502 and by holding plate 503.

Under the condition that the sheet bundle Sa is held, stopper plate 506 swings by 90° to retreat as shown in FIG. 3(*b*).

In the state of FIG. 3(*c*), spine SS of the sheet bundle Sa is away from coating roller 62.

Next, as shown in FIG. 3(*d*), coating device 60 storing therein glues P composed of hot-melt glues is driven by a motor (not shown) to ascend, and the coating roller 62 comes in contact with spine SS in the diagram of sheet bundle Sa. The coating roller 62 moves in the direction perpendicular to the page of FIG. 3 while being driven by motor M2 to rotate, to coat glues P on spine SS of sheet bundle Sa.

Next, the coating process will be explained as follows, referring to FIG. 4.

Figure 4:
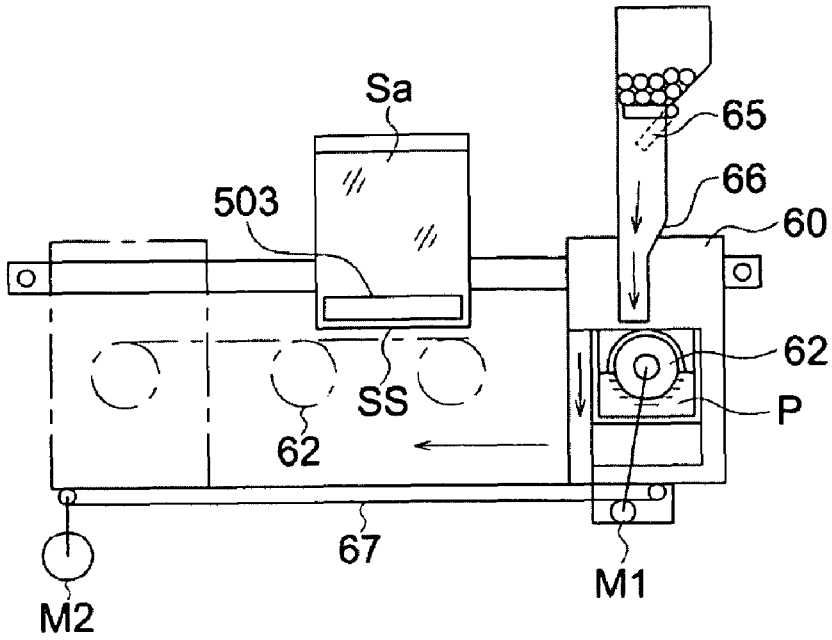
FIGS. 4(*a*)-4(*b*) are diagrams showing a glue coating process.
Figure 4:
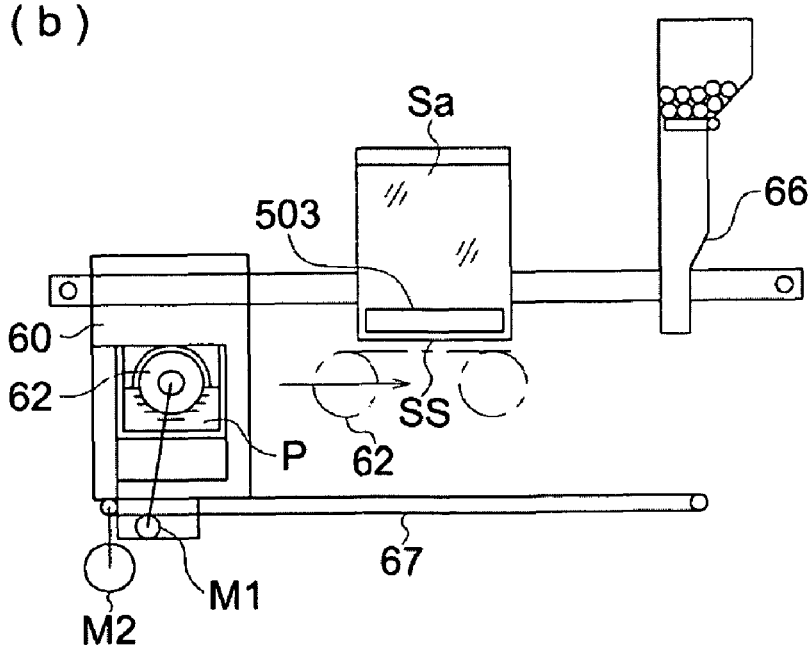

At the stage of start bookbinding in FIG. 4(*a*), coating device 60 is located at the right end position (first position) that is a home position. This position is located at the inner part when it is viewed from the front of bookbinding apparatus B shown in FIG. 2. At this right end position, solid glues are replenished to a glue container through replenishing path 66 when door 65 is opened. The coating device 60 moves in the direction toward the left side in FIG. 4(*a*) from a home position in the start of bookbinding process, and this movement from the home position to the left end position (second position) is carried out by the drive of belt 67 that is driven by motor M2. The motor M2 is started based on the signal of the detection conducted by sheet sensor SE provided at immediately downstream side of reversing tray 402 (see FIG. 2) for passage of a leading edge of the last sheet S1 constituting sheet bundle Sa that is stacked on sheet stacking section 50. During the period when the coating device 60 is moving to the left end position, coating roller 62 is away from spine SS of sheet bundle Sa.

Then, at the stage in FIG. 4(*b*) when coating device 60 is moving from the left end position toward the right end position, coating roller 62 is driven by a motor (not shown) to descend for touching spine SS of sheet bundle Sa to coat glues P. For starting a coating process in FIG. 4(*a*), timing control is conducted so that coating may be started after waiting a stop of conveyance for the cover sheet after being cut by cutter 81, when the sheet bundle Sa is set to be in the vertical state that makes coating to be possible.

The timing control of this kind makes operations of respective items to be conducted continuously, and makes bookbinding processing to be carried out at high efficiency.

After the coating device 60 has moved to its home position, cover sheet S2 is cemented with sheet bundle Sa.

Figure 5:
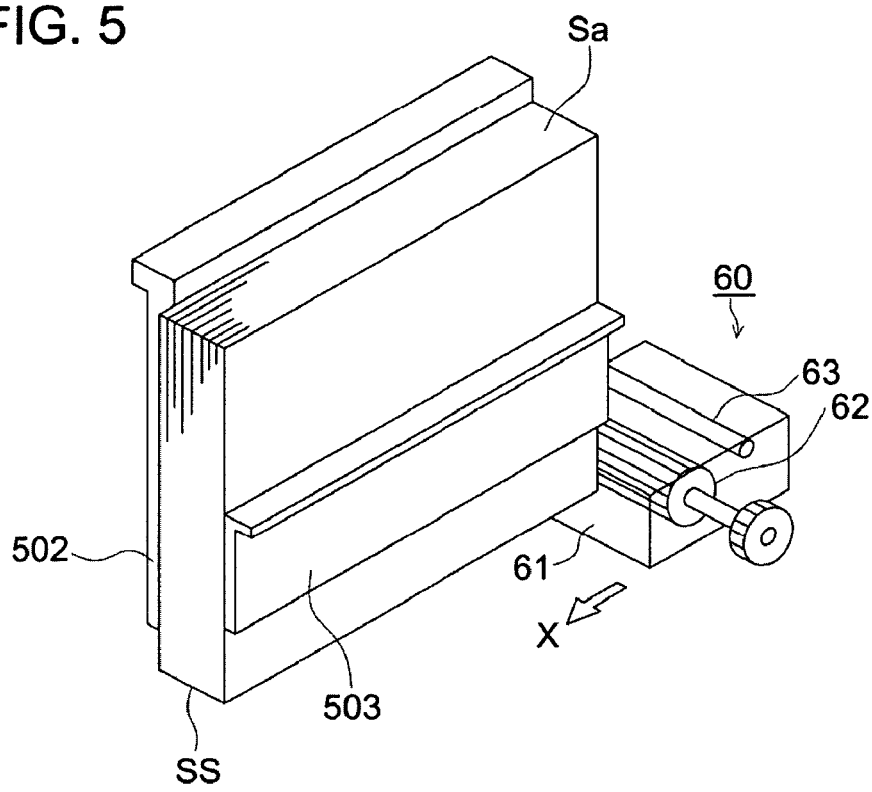
FIG. 5 is a diagram showing a glue coating process.

FIG. 5 is a conceptual diagram of glue coating device 60.

The glue coating device 60 coats glues stored in glue container 61 on spine SS of sheet bundle Sa with coating roller 62 that moves along the longitudinal direction of spine SS of sheet bundle Sa while rotating.

Figure 6:
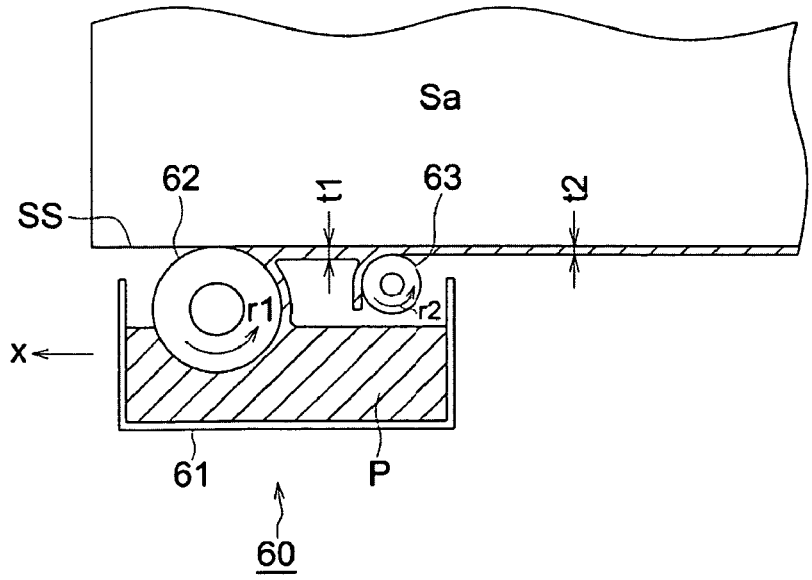
FIG. 6 is a diagram for illustrating control of coating thickness.

FIG. 6 is a diagram that illustrates relationship between a movement of glue coating device 60 and a coating thickness.

The glue coating device 60 moves in the direction of arrow x in the diagram, glues P (hatched portion in the diagram) in glue container 61 are guided by coating roller 62 that rotates in the direction of arrow r1 to spine SS of sheet bundle Sa, and glues in thickness t1 are coated on the sheet bundle Sa. The coating roller 62 is driven by motor M1 to rotate.

The aforesaid glues coated to be in thickness of t1 is scraped by scraping roller 63 that rotates in the direction of arrow r2 in the diagram so that a part of the aforesaid glues may be scraped off and prescribed thickness t2 of the glues may be obtained.

Glues thus scraped off are scraped from the surface of the roller by a scraping plate (not shown) that is in contact with the surface of the scraping roller 63, and are returned again to the glue container 61.

The aforesaid prescribed coating thickness t2 is altered by changing a distance from spine SS of sheet bundle Sa to scraping roller 63.

Figure 7:
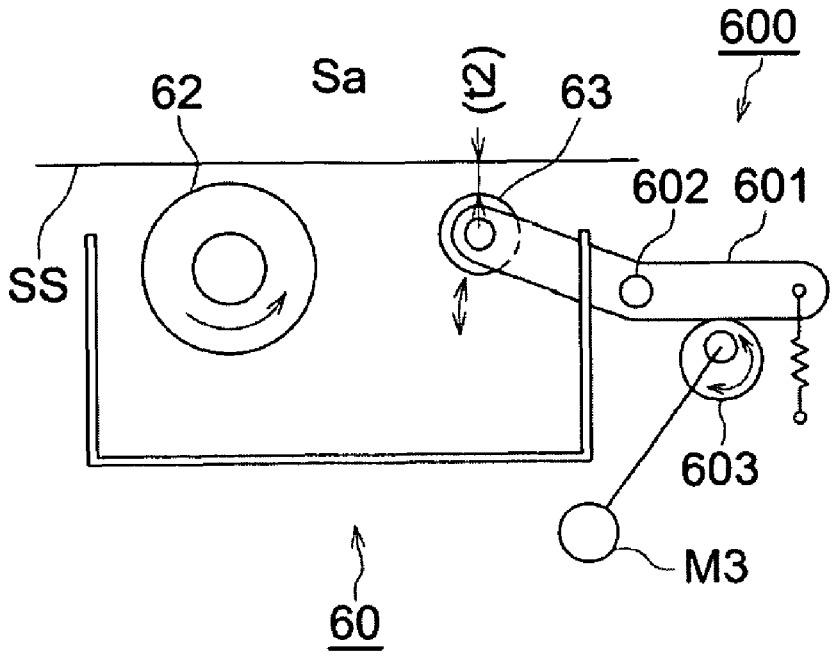
FIG. 7 is a diagram showing a coating thickness changing device.

FIG. 7 is a diagram for illustrating coating thickness changing device 600 that changes a coating thickness of glues.

The coating thickness changing device 600 is to be provided to be annexed to glue coating device 60, and the scraping roller 63 is mounted on the end portion of supporting member 601 that rotates around rotary shaft 602.

Eccentric cam 603 whose rotating angle is controlled by stepping motor M3 is in contact with the other end portion of the aforesaid supporting member 601, and a distance from scraping roller 63 to spine SS of sheet bundle Sa is changed by a phase of stopping of the eccentric cam 603.

Namely, a control device (which will be explained later) is a device to control coating thickness t2 by controlling a rotating angle from a standard stop position provided in advance for stepping motor M3.

Meanwhile, the aforesaid coating thickness t2 is one determined by a sheet type of sheet S that constitutes a thickness of sheet bundle Sa or the number of sheets and sheet bundle Sa.

(Cementing process)

Cover sheet S2 is cemented with sheet bundle Sa on which glues are coated.

A cementing process between sheet bundle Sa and cover sheet S2 will be explained as follows.

Figure 8:
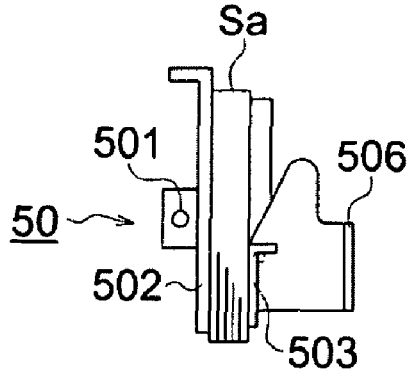
FIGS. 8(*a*)-8(*c*) are diagrams showing a cementing process for a cover sheet.
Figure 8:
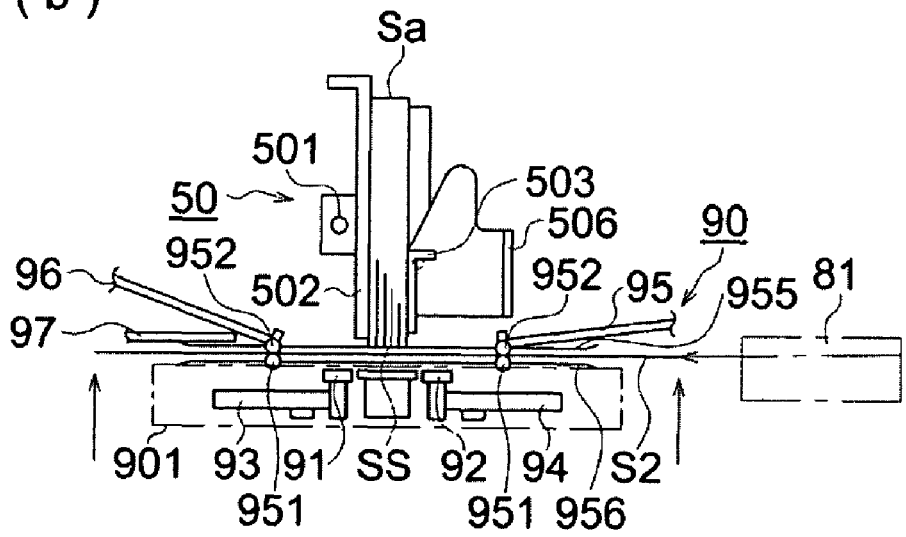
Figure 8:
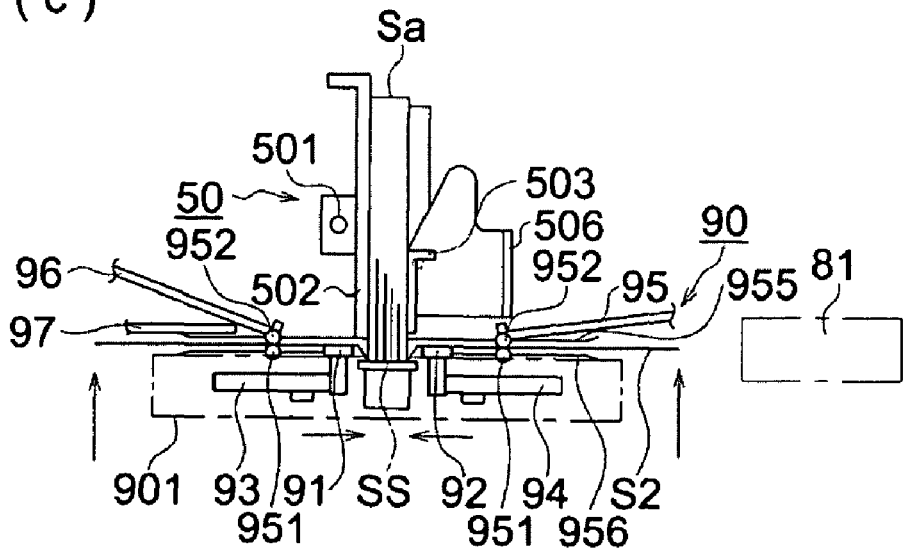

FIG. 8 is a sectional view of cover sheet supporting section 90 that supports cover sheet S2.

The cover sheet supporting section 90 is supported by belt 99A and belt 99B, and it is driven by motor M4 (see FIG. 2) constituting a moving device to move vertically. Cover sheet S2 is cover sheet S2A that is ejected from image forming apparatus A and is stored in cover sheet supporting section 90 through switching by conveyance path switching gate G1 (see FIG. 1), or is cover sheet S2B that is stored in sheet feeding tray 801 of cover sheet storage section 80 provided on the lower part of a bookbinding apparatus as shown in FIG. 2.

Cover sheet S2B is used when a sheet printed already is used as a cover sheet, or when a cover sheet that is not needed to be printed is necessary. Further, when bookbinding apparatus B is equipped with the second image recording means which will be described later, the cover sheet S2B is also used when even in the case where the second image recording device is used to print directly on cover sheet 2B.

The bookbinding apparatus B is equipped with second image recording device 85 that records an image on cover sheet S2B as shown in FIG. 2. The second image recording device 85 is arranged in the conveyance path covering from the cover sheet storage section 80 to cover sheet supporting section 90. The second image recording device 85 is composed of a recording device employing an ink-jet method in a line head form, or of a thermal recording device composed of a thermal head and an ink ribbon, and it can print on cover sheet S2B.

Cover sheet S2A or S2B is aligned by cover sheet supporting section 90, then, it takes a switchback course to be cut to the length corresponding to a bundle of sheet S1 by cutter 81 representing a cutting device, and is conveyed by a conveyance roller to be placed horizontally on cover sheet supporting device 901 shown with one-dot chain lines. Cover sheet supporting device 901 forms a horizontal plane that is composed of plural members such as pressing members 91 and 92 and cams 93 and 94 which drive the pressing members 91 and 92.

Meanwhile, cutter 81 cuts an end portion of cover sheet S2 to the length based on information about a size of cover sheet S2, information about a size of sheet S1, and on information about a thickness of sheet bundle Sa detected by sheet bundle thickness sensor 510. Incidentally, with respect to information of a thickness of sheet bundle Sa, it can also be obtained by multiplying a thickness of a single sheet of sheet S1 for recording by the number of sheets for recording based on counting of the number of documents, or by the number of sheets for recording obtained from information of images received from outer equipment, or from information of images received which are inputted at the operation section of an image forming apparatus, in addition to information obtained by actual measurement. Chips of cover sheet S2 after cutting are collected in a chip box (not shown).

Cover sheet S2 cut to the prescribed length is fed out by a conveyance roller, and is inserted into a space between cover sheet holding members 95 and 96 on which a clearance of about 5 mm is provided. The cover sheet S2 is conveyed by cover sheet conveyance rollers 951 and by driven rollers 952 provided respectively at tips of the cover sheet holding members 95 and 96. The cover sheet S2 is controlled to stop when it comes to a prescribed position based on information of a size of the cover sheet S2 and on information of a thickness of a bundle of sheets S1.

Cover sheet holding member 95 is provided, with its right end serving as an axis, rotatably on cover sheet supporting section 90, and each of cover sheet holding members 96 and 97 is provided, with its left end serving as an axis, rotatably on cover sheet supporting section 90.

Figure 9:
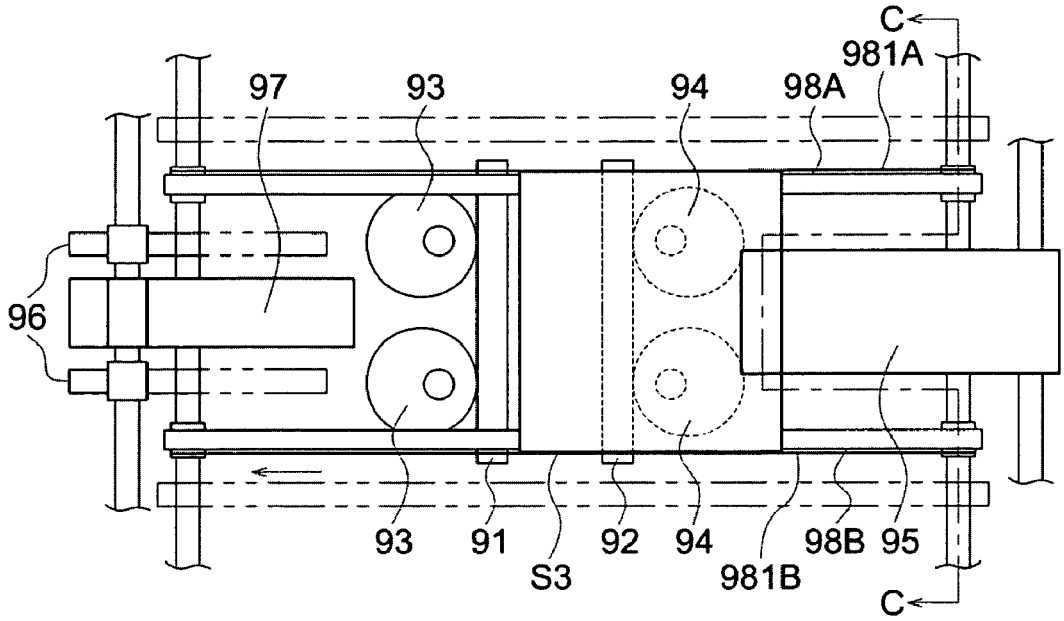
FIGS. 9(*a*)-9(*b*) are diagrams showing a cover sheet supporting section.
Figure 9:
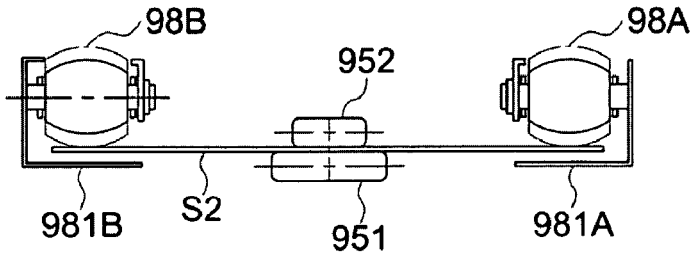

FIG. 9(*a*) is a top view of cover sheet supporting device 901, and FIG. 9(*b*) is a sectional view taken on line C-C.

Each of belts 98A and 98B conducts aligning operations to correct skewing of the conveyed cover sheet S2, and conducts operations to convey bound booklet S3 to booklet ejection section 100.

Aligning members 981A and 981B which align both sides of cover sheet S2 in the direction parallel with the conveyance direction for the cover sheet S2 are provided as an aligning device for the cover sheet S2, and drum-shaped rollers about which belt 98A and belt 98B are respectively trained are attached on the aligning members 981A and 981B respectively. The aligning members 981A and 981B conduct aligning operations each time the cover sheet S2 is carried in. Further, when cover sheet supporting device 901 which will be described later rises, the aligning members 981A and 981B as well as belts 98A and 98B are retreat to positions shown with two-dot chain lines in FIG. 9(*a*).

FIG. 8(*b*) shows a situation wherein cover sheet S2 is held by cover sheet holding members 95 and 96, and is caused by motor M4 that drives belts 99A and 99B (see FIG. 2) to ascend as it is together with cover sheet supporting device 901, and the cover sheet S2 is cemented with sheet bundle Sa.

The cover sheet supporting device 901 further ascends from the position in FIG. 8(*b*) by several mm. The position to which the cover sheet supporting device 901 has ascended by several mm is a position shown in FIG. (c). After the ascent, pressing members 91 and 92 press the cover sheet S2 from both left and right sides, and give corners respectively to a boundary between a spine and a front cover and to a boundary between a spine and a back cover to form spine corners, thus, the cover sheet S2 is caused to adhere closely to sheet bundle Sa, and booklet S3 is formed. Pressing force of each of the pressing members 91 and 92 is about 200 Nf.

Further, movements of the pressing members 91 and 92 in horizontal directions are conducted by cams 93 and 94 (see FIG. 9 together) which are driven by motor M5 (that is explained later), in terms of a means. Meanwhile, movements of the pressing members 91 and 92 may also be by composition wherein a rack is provided on each member, and each of the pressing members 91 and 92 is moved by a rotation of a pinion that engages with the rack.

After the cover sheet S2 has been cemented, the pressing members 91 and 92 are released and cover sheet supporting section 90 is driven by motor M4 (see FIG. 2) to descend by about 100 mm to return to its home position, after cover sheet holding members 95, 96 and 97 are driven by motor M5 to rotate to release pressing of cover sheet S2. Namely, cover sheet supporting section 90 leaves booklet S3 as shown in FIG. 10.

Figure 10:
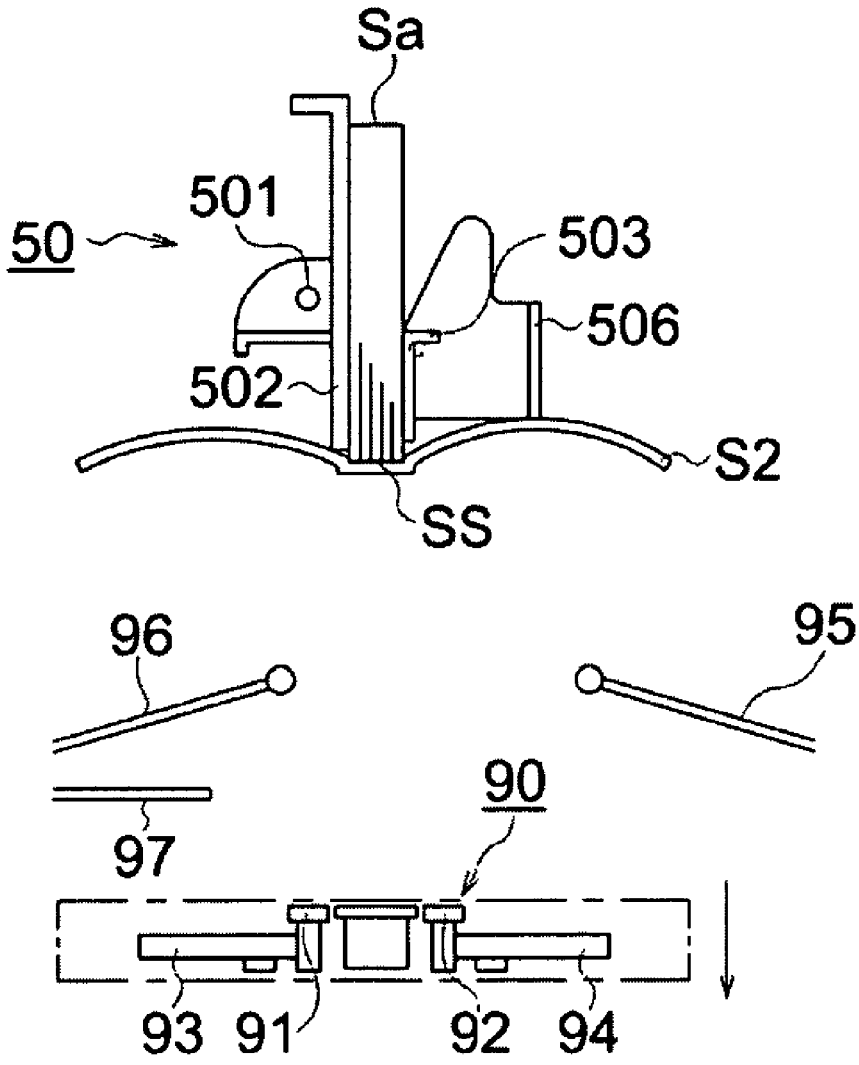
FIG. 10 is a diagram showing movement of a cover sheet supporting section to a home position.

Under the situation shown in FIG. 10, belts 98A and 98B of cover sheet supporting section 90 operate, and under the situation wherein belts 98A and 98B are operating, holding plate 503 releases the holding, and booklet S3 falls on the cover sheet supporting section 90.

The booklet S3 thus has fallen is ejected to booklet ejection section 100.

In the cementing processing explained earlier, cementing conditions such as pressure of cover sheet S2 for a glue layer formed on spine SS of sheet bundle Sa and a length of a period of time for applying the pressure have influences on strength of booklet S3 and on the result of booklet S3. In addition, strength and the result of booklet S3 are closely related to a coating thickness of glues.

Strength of booklet S3 that is made by cementing cover sheet S2 with sheet bundle Sa is expressed mainly by adhesive strength and by resistance for spine breakage.

The adhesive strength is resistance for extracting force when the extracting force is applied on one or plural sheets S1 in sheet bundle Sa.

The resistance for spine breakage is the difficulty of spine breakage for opening force in the case of opening booklet 3.

When glues penetrate more into respective sheets S1 which form sheet bundle Sa and into a space between sheet S1 and sheet S1, the adhesive strength is more enhanced.

For enhancing the adhesive strength, it is effective to apply pressure on a glue layer formed on a spine, before the glues are solidified, in the course of glue coating or after glue coating.

Further, the thicker is the glue layer formed on a spine of sheet bundle Sa, the higher is the resistance for spine breakage.

For enhancing the resistance for spine breakage, it is effective to increase a thickness of a glue layer on sheet bundle Sa.

In addition, for improving quality of booklet S3, it is required that an outer surface of the cover sheet is free from irregularities, because irregular side glues are not allowed and a thickness of a glue layer formed on a spine of sheet bundle Sa is required to be uniform.

It is necessary to clear these conditions concerning quality of a booklet.

Figure 11:
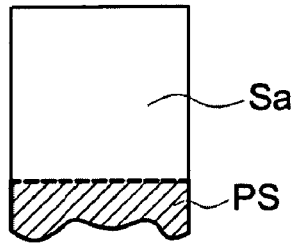
FIGS. 11(*a*)-11(*d*) are diagrams showing a cementing process for a cover sheet.
Figure 11:
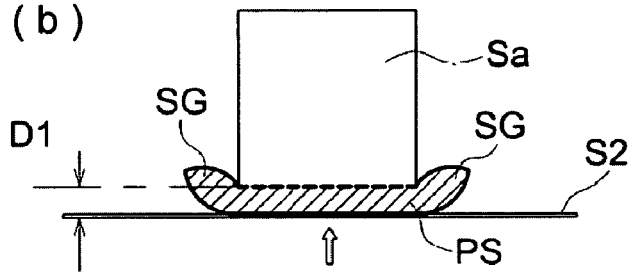
Figure 11:
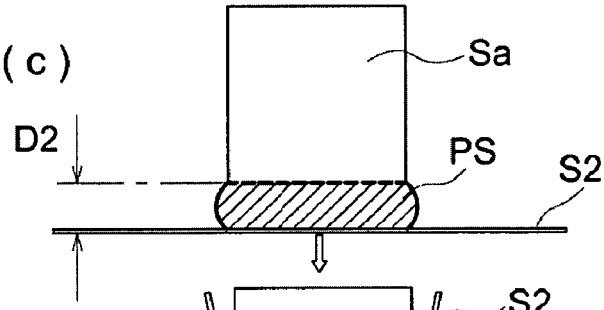
Figure 11:
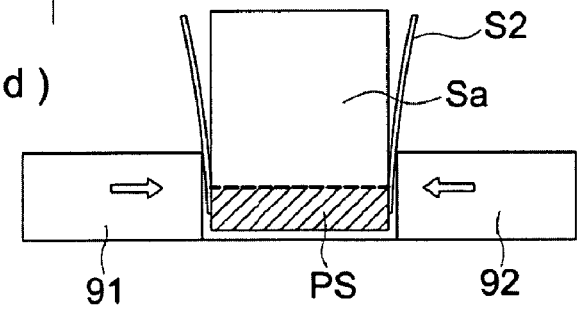

Next, a cementing processing that can clear these conditions will be explained as follows, referring to FIG. 11. In FIG. 11, a boundary between glue layer PS and sheet bundle Sa is shown with dotted lines which indicate that glues are penetrated into inside of sheet bundle Sa.

FIG. 11(*a*) shows a state of a glue layer in the stage when a coating process is completed.

On a spine of sheet bundle Sa, there is formed glue layer PS which is formed so that its thickness at each of both end portions in the direction of a thickness of sheet bundle Sa may be thicker.

Cover sheet S2 is pushed against glue layer PS in FIG. 11(*a*). FIG. 11(*b*) shows a state wherein sheet S2 is pushed against the glue layer.

Since the cover sheet S2 is pushed against so that distance D1 between a spine of sheet bundle Sa and a surface of the cover sheet S2 is smaller than a thickness of glue layer PS in FIG. 11(*a*), glues are pushed out at both end portions to form side glues SG as illustrated.

When the cover sheet S2 is pushed against as stated above, pressure is applied on glue layer PS, resulting in penetration of glues into the inside of sheet bundle Sa.

Namely, the adhesive strength of a booklet is enhanced by the process shown in FIG. 11(*b*).

Next, a distance between a spine of sheet bundle Sa and cover sheet S2 is enlarged to D2 that is greater than D1, as shown in FIG. 11(*c*).

Though an enlargement to distance D2 is conducted by lowering cover sheet supporting device 901, it is also possible to enlarge by raising supporting plate 502 (see FIGS. 2 and 5) representing a sheet bundle supporting device.

Owing to a distance enlarging processing shown in FIG. 11(*c*), side glues SG in FIG. 1i(*b*) are almost eliminated, and a thickness of glue layer PS is increased.

Due to this, resistance for spine breakage is increased, and forming of irregular side glues can be prevented.

Next, in FIG. 11(*d*), pressing members 91 and 92 representing bending devices for bending the cover sheet press the cover sheet S2 against sheet bundle Sa from both left and right sides, thus, the cover sheet S2 is bent as illustrated and spine corners are formed.

A condition for quality of a booklet, a condition for strength of a booklet in particular, is basically satisfied by the cementing processing shown in FIG. 11.

Figure 12:
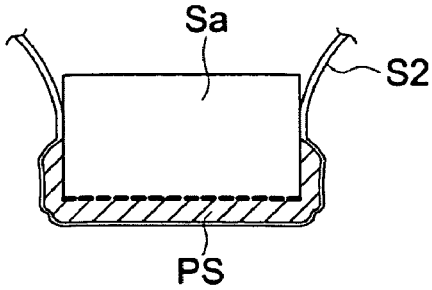
FIG. 12 is a diagram showing an example of a booklet.

Meanwhile, in the case glue-binding to cement both of cover sheet S2 and sheet bundle Sa while wrapping the sheet bundle Sa with the cover sheet S2, there is a problem shown in FIG. 12, in addition to problems concerning uniformity in adhesive strength, side glues and a thickness of a glue layer which were explained earlier, and it is desirable to avoid that a booklet shown in FIG. 12 is formed.

As shown in FIG. 12, when processing to bend cover sheet S2 is implemented when glue layer PS is thick and viscosity of glues is low, formation of spine corners is not sufficient, and the result on the end portion of the spine of booklet S3 is worsened.

To satisfy various conditions concerning booklet quantity explained earlier, various contributing factors such as a thickness of a booklet and behaviors of glues are considered and adjustment in a cementing process is carried out, and it is possible to make a booklet with high quality by adjusting as follows on the base of a cementing process shown in FIG. 11.

In the adjustment explained as follows, a thickness of a glue layer is adjusted in a way shown in FIGS. 5 and 6, and it is implemented by adjustment of scraping roller 63.

A thickness of a glue layer is adjusted, corresponding to booklet conditions. Namely, a thickness of a glue layer is adjusted, corresponding to a thickness of the sheet bundle Sa and to a sheet type of sheets constituting a booklet, and when a booklet is thicker, a glue layer is made to be thicker, exemplifying that a glue layer for coated paper is thicker than that for an ordinary sheet.

Meanwhile, an adjustment process explained below is implemented when sheet bundle Sa has a thickness that is equal to or higher than a prescribed value, and when a thickness of sheet bundle Sa is lower than the aforesaid prescribed value, glues are coated so that a layer thickness may be in a prescribed value.

That is, when a thickness of sheet bundle Sa is less than 7 mm, for example, it is not necessary to implement adjustment of a glue layer thickness and a cementing process shown in FIG. 11.

A cementing process for a cover sheet shown in FIG. 11 and adjustment explained below are implemented by a control system shown in FIG. 13.

Figure 13:
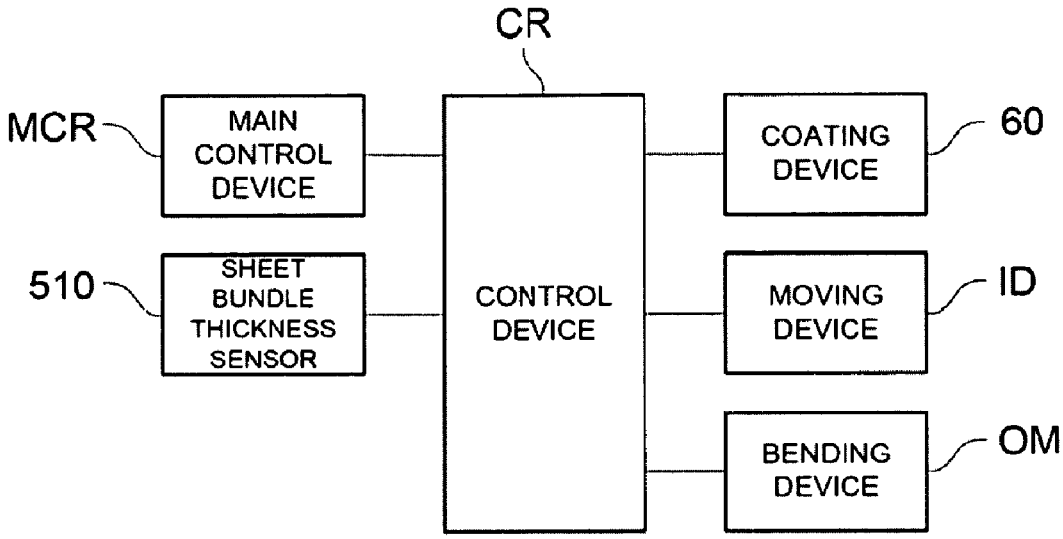
FIG. 13 is a diagram showing a control system of a bookbinding system relating to an embodiment of the invention.
Figure 14:
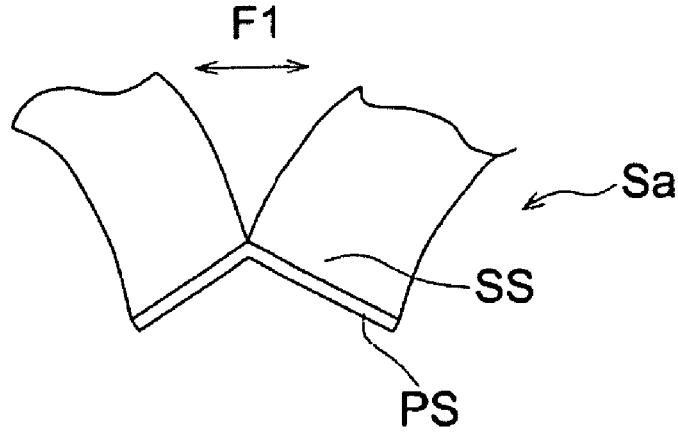
FIGS. 14(*a*)-14(*c*) are diagrams for illustrating the booklet strength.
Figure 14:
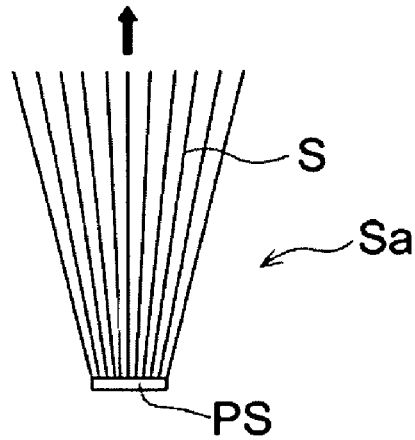
Figure 14:
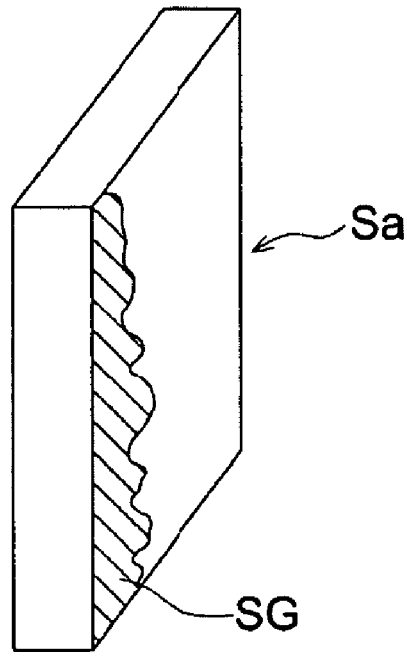

In FIG. 13, CR represents a control device that is provided in bookbinding apparatus B to conduct control of inside of the bookbinding apparatus B, and MCR represents a control device that is provided in image forming apparatus A to conduct control of overall bookbinding system.

The control device CR controls motors M1 and M2 of coating device 60 to coat glues, and also controls motor M3 of coating device 60 to control a thickness of a glue layer.

For the purpose of controlling a thickness of a glue layer, there is used an optional well-known coating thickness control device that controls the speed of rotation of motor Ml, and selects coating only for movement of the coating device 60 in one direction or coating for reciprocating movement of the coating device 60.

ID represents a moving device that moves cover sheet supporting device 901, and it is composed of motor M4 and belts 99A and 99B (see FIG. 2).

The control device CR controls a distance between spine SS of sheet bundle Sa and cover sheet S2 by controlling operation timing and an amount of operations of motor M4.

OM represents a device to bend cover sheet S2, and it is composed of pressing members 91 and 92 as well as cams 93 and 94 which are shown in FIGS. 8 and 9 and of motors which drive the cams 93 and 94. The control device CR controls timing for a process to bend cover sheet S2 and thereby to form spine corners, by controlling a motor constituting bending device OM.

The control device CR conducts a cover sheet cementing process shown in FIG. 11 and adjustment illustrated below, based on results of detection by sheet bundle thickness sensor 510 and on information received from main control device MCR.

A thickness of a glue layer is controlled based on information of detection by the sheet bundle thickness sensor 510, and basically, the thicker the sheet bundle Sa is, the thicker a glue layer is.

As an actual control, there is used a control method wherein when a thickness of sheet bundle Sa is a prescribed value such as one less than 7 mm, for example, a coating thickness is made to be in a fixed value, while, if a thickness of sheet bundle Sa is equal to or greater than a prescribed value, a coating thickness is made to be one corresponding to the thickness of the sheet bundle Sa.

Meanwhile, it is also possible to control a coating thickness for glues by calculating a thickness of sheet bundle Sa based on information of the number of sheets constituting a sheet bundle received from main control device MCR and on information of sheet type.

Further, when determining a coating thickness, it is also possible to add information of a sheet type to information of a thickness of sheet bundle Sa.

For example, a thickness of a glue layer is controlled to be thick, when permeability for glues is low as in the case of coated paper, and when a sheet type requires high booklet strength.

Adjustment in a cementing process is as follows.

(1) Amount of Pushing and of Drawing Away for Cover Sheet S2

A distance in the case of pressing, namely, distance D1 in FIG. 11(*b*) and a distance in the case of drawing away, namely, distance D2 in FIG. 11(*c*) are changed corresponding to a thickness of a glue layer.

Specifically, the thicker a glue layer is, the greater a distance in the case of pressing (distance D1) and a distance in the case of drawing away (distance D2) are made to be.

When a glue layer is thick, heat capacity of the glue layer is great, and temperature declining speed of the glue layer is low.

Therefore, distance D1 is made to be great to make an amount of side glues to be small.

Incidentally, permeability of glues into a sheet bundle is not lowered even when the distance D1 is made to be great, because viscosity glues is low, and necessary adhesive strength can be secured.

Control for adjusting distances D1 and D2 is conducted by controlling an amount of operations of motor 4 for moving device ID.

(2) Time WT from Completion of Coating to Start of Pressing Cover Sheet

Time WT from completion of coating to start of pressing cover sheet is changed in accordance with a thickness of a glue layer.

Specifically, when a glue layer is thicker, time WT is made to be longer.

If a glue layer is thick, glue hardening speed is slow. Accordingly, if time WT is short, side glues grow greater, and formation of spine corners is worsened as shown in FIG. 12.

A standard value of time WT is about one second.

(3) Time HT from Completion of Pressing to Start of Drawing Away

The state of processing in FIG. 11(*b*) is maintained, and time HT up to start of processing in FIG. 11(*c*) is changed in accordance with a thickness of a glue layer.

Specifically, when a glue layer is thicker, time HT is made to be longer.

When a thickness of a booklet is greater, a glue layer is made to be thicker. Therefore, a thicker glue layer is formed when booklet strength is required to be increased.

By making time HT for pressing shown in FIG. 11(*b*) to be longer, adhesive strength is increased and booklet strength is increased.

Time WT and time HT are controlled by controlling driving time for motor M4 for moving device ID.

(4) Time MT from Drawing Away to Start of Cover Sheet Bending

Time MT for maintaining the state of FIG. 11(*c*) is made to be prescribed time, for example, three seconds.

By maintaining the state of FIG. 11(*c*) for prescribed time, a glue layer having a desired layer thickness is formed, and hardening of glues is advanced.

When glues are hardened and viscosity thereof is enhanced to a prescribed value, spine corners of booklet S3 are formed to be in a desired shape.

(5) Bending Time OT

The state shown in FIG. 11(*d*), namely, time OT during which cover sheet S2 is bent and booklet S3 is interposed by pressing members 91 and 92 is changed in accordance with a thickness of a glue layer.

By preserving the state of FIG. 11(*d*) for a long time, spine corners are formed satisfactorily, and a high-quality booklet can be made.

A booklet having a thick glue layer, namely, a thick booklet is composed of a large number of sheets.

In the bookbinding system shown in FIG. 1, with respect to sheets constituting a booklet, processing for one sheet takes fixed time because each sheet is finished after images are formed on each sheet.

Therefore, in the case of a thick booklet composed of many constituting sheets, processing time for sheets constituting one booklet is longer. Thus, it is possible to make a high-quality booklet, by elongating a period of time of a process of FIG. 11(*d*), namely, bending time OT, by utilizing a characteristic of the process in the consistent processing from image forming up to bookbinding.

Control of time MT and control of time OT are carried out by controlling operation time for a motor that constitutes bending device OM that bends cover sheet S2.

In the embodiment, glues are coated on a spine of a sheet bundle, then, a cover sheet is cemented on a spine, and after the cementing, a distance between the spine and the cover sheet is extended. Therefore, glues penetrate sufficiently into sheets and into a space between sheets, and a thickness of a glue layer can be secured sufficiently, and further, formation of irregular side glues can be inhibited sufficiently.

Therefore, it is possible to realize a bookbinding apparatus and a bookbinding system wherein a booklet that is sufficient in terms of strength and quality can be prepared.

What is claimed is:

1. A bookbinding apparatus comprising:

a glue coating device that coats glue on a back of a sheet bundle;

a sheet bundle supporting device that supports the sheet bundle on which glue is coated;

a cover sheet supporting device that supports a cover sheet;

a moving device that moves at least one of the sheet bundle supporting device and the cover sheet supporting device, and thereby changes a distance between the back of the sheet bundle supported by the sheet bundle supporting device and the cover sheet supported by the cover sheet supporting device; and a control device that controls the moving device so that the cover sheet contacts the glue coated on the back of the sheet bundle with a distance D1 between the back of the sheet bundle and the cover sheet, and thereafter the sheet bundle and the cover sheet contacting the glue coated on the back of the sheet bundle are supported with a distance D2 between the back of the sheet bundle and the cover sheet, the distance D2 being greater than the distance D1.

2. The bookbinding apparatus of claim 1, further comprising:

a bending device that bends the cover sheet to wrap the sheet bundle with the cover sheet, wherein the control device sets the distance to D2 for controlling the bending device so that the cover sheet wraps the sheet bundle.

3. The bookbinding apparatus of claim 1, wherein the control device controls the glue coating device to control the coating thickness of the glue coated on the back of the sheet bundle.

4. The bookbinding apparatus of claim 3, wherein the control device controls to change the distance D1 corresponding to the coating thickness of glue.

5. The bookbinding apparatus of claim 3, wherein the control device controls to change the distance D2 corresponding to the coating thickness of glue.

6. The bookbinding apparatus of claim 3, wherein the control device controls to change a span from a time of completing the coating process by the glue coating device to a time of setting the distance to the distance D1 corresponding to the coating thickness of glue.

7. The bookbinding apparatus of claim 3, wherein the control device controls to change the span from the time of setting the distance to D1 to the time of setting the distance to D2 corresponding to the coating thickness of glue.

8. The bookbinding apparatus of claim 2, wherein the control device controls the bending device to start bending of the cover sheet, after having maintained a state in which the distance to the distance D2 for a predetermined span is set.

9. The bookbinding apparatus of claim 8, wherein the control device controls to change the predetermined span corresponding to the coating thickness of glue.

10. The bookbinding apparatus of claim 2, wherein the control device controls a span in which a state in which the bending device bends the cover sheet is maintained corresponding to the coating thickness of glue.

11. The bookbinding apparatus of claim 3, further comprising:

a sensing device to detect a booklet condition, wherein the control device controls the glue coating device to change the coating thickness of glue corresponding to a booklet conditions detected by the sensing device.

12. The bookbinding apparatus of claim 3, further comprising:

a sensing device to detect sheet bundle thickness, wherein the control device controls the glue coating device to change the coating thickness of glue corresponding to information detected by the sensing device.

13. A bookbinding system comprising;

the bookbinding apparatus of claim 1; and an image forming apparatus that forms an image on a sheet and conveys the sheet on which an image is formed to the bookbinding apparatus.

* * * * *